US010046225B2

(12) United States Patent
Gilmore

(10) Patent No.: US 10,046,225 B2
(45) Date of Patent: Aug. 14, 2018

(54) METHOD AND DEVICE FOR PRACTICING GOLF PUTTING

(71) Applicant: Peter Lawrence Gilmore, Mamaroneck, NY (US)

(72) Inventor: Peter Lawrence Gilmore, Mamaroneck, NY (US)

( * ) Notice: Subject to any disclaimer, the term of this patent is extended or adjusted under 35 U.S.C. 154(b) by 200 days.

(21) Appl. No.: 14/622,277

(22) Filed: Feb. 13, 2015

(65) Prior Publication Data

US 2016/0114235 A1 Apr. 28, 2016

Related U.S. Application Data

(60) Provisional application No. 62/067,024, filed on Oct. 22, 2014.

(51) Int. Cl.

| | |
|---|---|
| ***A63B 57/00*** | (2015.01) |
| ***A63B 69/36*** | (2006.01) |
| ***A63B 63/00*** | (2006.01) |
| *A63B 71/04* | (2006.01) |

(52) U.S. Cl.

CPC ..... *A63B 69/3676* (2013.01); *A63B 63/00* (2013.01); *A63B 71/04* (2013.01); *A63B 2063/002* (2013.01); *A63B 2208/0204* (2013.01); *A63B 2210/50* (2013.01)

(58) Field of Classification Search

CPC ... A63B 57/357; A63B 57/40; A63B 2208/12; A63B 69/3676; A61F 5/00

USPC ..... 473/175; 602/4, 16, 23, 32

See application file for complete search history.

(56) References Cited

U.S. PATENT DOCUMENTS

| | | | | | |
|---|---|---|---|---|---|
| 4,241,731 | A * | 12/1980 | Pauley | A61F 5/3753 | 602/4 |
| 4,423,875 | A * | 1/1984 | Miller | A63B 69/36 | 473/265 |
| 5,209,484 | A * | 5/1993 | Randall | A63B 69/3676 | 473/265 |
| 5,437,448 | A * | 8/1995 | Balson | A63B 69/3623 | 473/257 |
| 8,343,083 | B1 * | 1/2013 | Fencel | A61F 5/0123 | 602/23 |
| 8,821,308 | B2 * | 9/2014 | Chiang | A63B 69/3623 | 473/257 |
| 8,864,596 | B1 * | 10/2014 | Maranian, Jr. | A63B 69/3661 | 473/162 |
| 2008/0200856 | A1 * | 8/2008 | Cadichon | A61F 5/0123 | 602/32 |
| 2013/0035623 | A1 * | 2/2013 | Nace | A61F 5/0123 | 602/16 |
| 2015/0360111 | A1 * | 12/2015 | Lee | A63B 67/02 | 473/157 |

* cited by examiner

*Primary Examiner* — Gene Kim
*Assistant Examiner* — Christopher Glenn
(74) *Attorney, Agent, or Firm* — Haug Partners LLP

(57) ABSTRACT

A golf putting aid device comprising an alley formed by at least one arm member that extends from a golf hole to a user; and a cup member being capable of being placed in the golf hole.

15 Claims, 11 Drawing Sheets

METHOD AND DEVICE FOR PRACTICING GOLF PUTTING

RELATED APPLICATIONS

This application claims benefit of U.S. Provisional Application No. 62/067,024, titled "Method and Device for Practicing Golf Putting," filed on Oct. 22, 2014, the entirety of which is incorporated herein by reference.

FIELD OF THE INVENTION

This invention relates generally to a device and method for practicing golf putting.

BACKGROUND DISCUSSION

In golf, a putt typically refers to instances where a player swings a club (typically a putter) to roll a golf ball along a green to put the golf ball in the hole or closer to the hole. The distance of a putt from a golf ball to a hole depending on the course and the shots already played up to that point for that hole can be any distance. Typically, putts range from a few feet to 20 or 30 feet. A long putt, sometimes called a lag, may have a distance up to 60 feet.

The putting performance of a player is important in determining a player's score. For example, on a typical 18-hole course, there are par 3s, par 4s, and par 5s. On a par 3, the hole is supposed to be played in such a way that a player hits the green on his first shot and then uses two putts to hole the ball, which means that putting makes up 66% of the score. On a par 4, the hole is supposed to be played in such a way that a player hits the green on his second shot and then uses two putts to hole the ball, which means that putting makes up 50% of the score. On a par 5, the hole is supposed to be played in such a way that a player hits the green on his third shot and then uses two putts to hole the ball, which means that putting makes up 40% of the score. Indeed, statistics has shown that even professional golfers have used as many as two thirds of their strokes in putting. Common sense suggests that a player should focus his practice time on putting, hoping that his or her putting would be more reliable and more precise. But even the best golfers may not be able to achieve a successful rate of about 60% for a 15-foot putting range.

Putting basics can be broken down to many elements, such as confidence, aim, path, face angle, posture, grip, impact, rhythm, and stability. Many available putting training devices have been designed to assist a player to practice one or more elements, including Z Factor Perfect Putting Machine, EyeLine Golf Putting Sword, Train Eye Golf Putting Trainer, and Path Finder. These devices share a common drawback that they choose to focus on placing the training device in an area that is adjacent to where the golf ball is, but fail to provide a clear alley or path originated from the cup. These devices may help golfers in their grip, posture, or stability, but they are inadequate in training golfers in the elements of aim and path.

SUMMARY

In summary, this application is directed to a training aid for putting and a method thereof. According to an embodiment, the putting aid device, which provides a regulation-sized cup, has two arms that are extendable to provide a user with a visual putting lane or indication or path. The cup fits in a standard golf hole so it can be used on a real golf course.

When the device is used outside, the arms are capable of running along a putting surface.

The device as set forth in the present disclosure can also be used indoors. The cup that is inserted into the hole outdoors rotates on swiveling arms capable of forming an inverted hole to allow it to be used indoors (home, office, etc.) with the arms running along the floor. The arms are extendable, such as extending at least 4 feet. Each of the arms is capable of rotating about 360 degrees around a hinge that connects the arms with the cup. Each of the arms is also capable of extending in a horizontal direction, thus making the path/projection/width formed by the two arms adjustable. In this way, the device allows a user to practice putting with a variable width of an aligned path/projection to the cup.

According to an aspect, the present application is directed to a golf putting aid device comprising an alley formed by at least one arm member that extends from a golf hole in a direction toward a user; and a cup member being capable of being placed in the golf hole.

According to some embodiments of the present application, the alley is formed by two parallel arm members; the arm members are configured to have adjustable length, the alley is configured to have adjustable width, and/or the arm member includes a plurality of sections that are coaxially attached with each other.

According to some embodiments of the present application, the cup member is configured to switch between a first position that is underneath the alley to a second position that is above the alley, the first position being used to fit the cup member in a golf hole and the second position being used for simulating a golf hole, the cup member is rotatable around the arm members; the cup member includes a semi-cylinder portion; and/or the cup member includes a full cylinder portion.

According to some embodiments of the present application, the golf putting aid device further comprises a base member that attaches to both the arm member and the cup member. The base member and the cup member are portions of a single part; the cup member is rotatably attached to the base member; the cup member is attached to the base member by a snap on/off mechanism; and/or the base member has a plurality of anti-slippery pads.

According to some embodiments of the present application, the golf putting aid device further comprises an arch member attached to the alley. The arch member includes at least one groove configured to accommodate a predetermined portion of the arm member; the arch member is capable of being folded into the alley; the arch member has a generally semi-circle configuration; the arch member gradually reduces its profile from a bottom part to the top; the arch member is capable of forming a 90° angle with the alley, the arch member is configured to slide along the at least one arm member, the arch member is removable from the at least one arm member, and/or the arm member includes a plurality of sections that are coaxially attached with each other.

BRIEF DESCRIPTION OF THE DRAWINGS

To accomplish the foregoing and related ends, certain illustrative embodiments of the invention are described herein in connection with the following description and the annexed drawings. These embodiments are indicative, however, of but a few of the various ways in which the principles of the invention may be employed and the present invention is intended to include all such aspects and their equivalents.

Other advantages, embodiments and novel features of the invention may become apparent from the following description of the invention when considered in conjunction with the drawings. The following description, given by way of example, but not intended to limit the invention solely to the specific embodiments described, may best be understood in conjunction with the accompanying drawings, in which:

FIG. 1(*b*) shows a side view of the putting aid device 100 of FIG. 1(*a*) according to an embodiment of the present application.

FIG. 1(*c*) shows a front view of the putting aid device 100 of FIG. 1(*a*) according to an embodiment of the present application.

FIG. 1(*d*) shows a top view of the putting aid device 100 of FIG. 1(*a*) according to an embodiment of the present application.

FIG. 7(*b*) shows a perspective view of a putting aid device according to an embodiment of the present application.

FIG. 8(*b*) shows a perspective view of a putting aid device 800 reduced to practice according to an embodiment of the present application.

FIG. 9(*b*) shows a perspective view of a putting aid device 900 according to an embodiment of the present application.

DETAILED DESCRIPTION

Figure 1A:
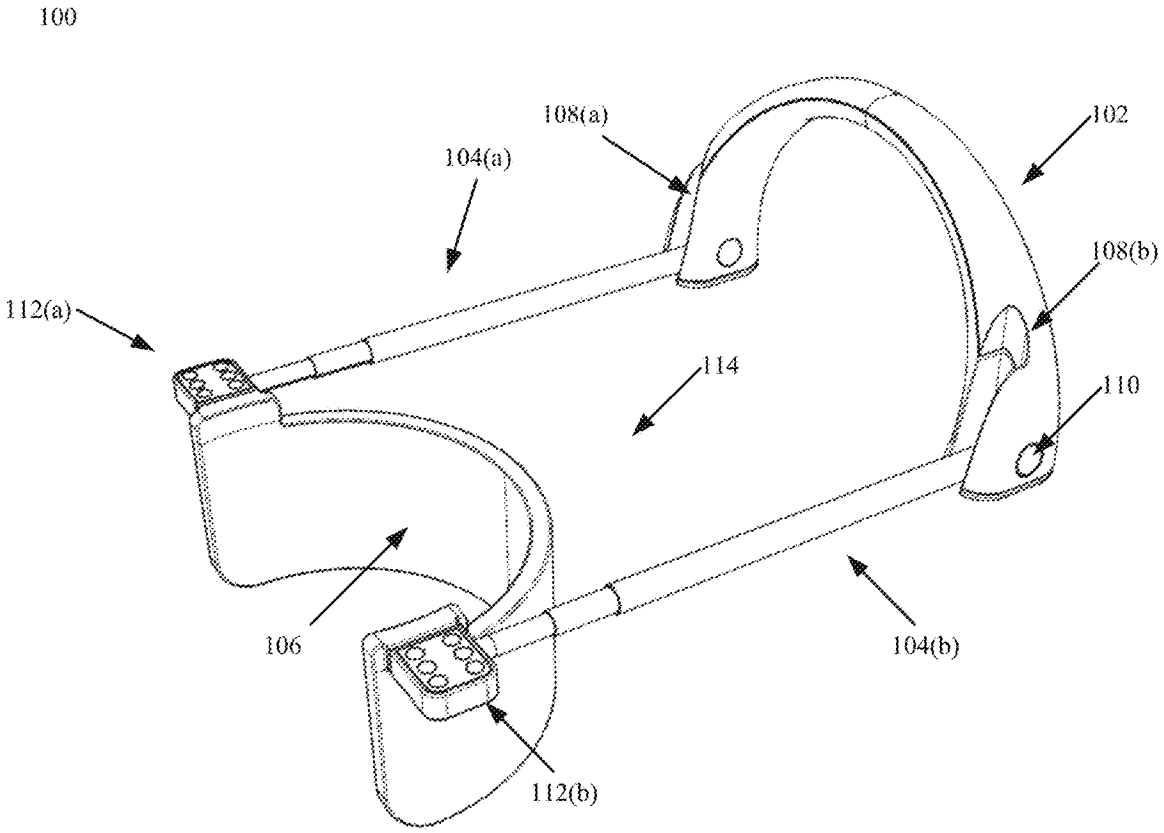
FIG. 1(*a*) shows a perspective view of a putting aid device 100 in an outdoor mode according to an embodiment of the present application.
Figure 1C:
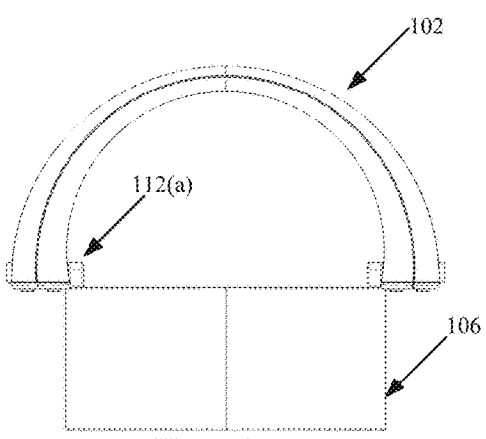
Figure 1B:
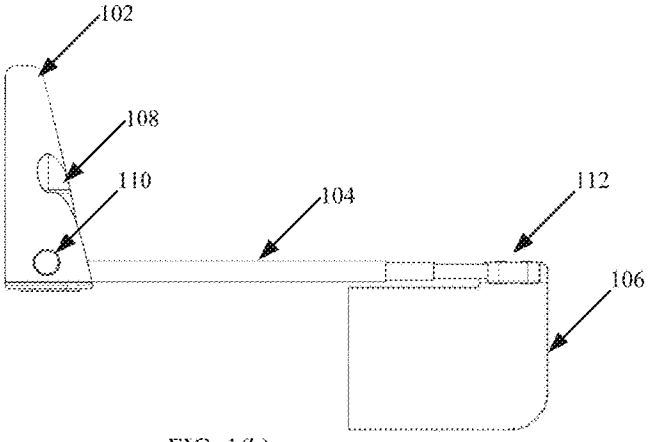
Figure 1D:
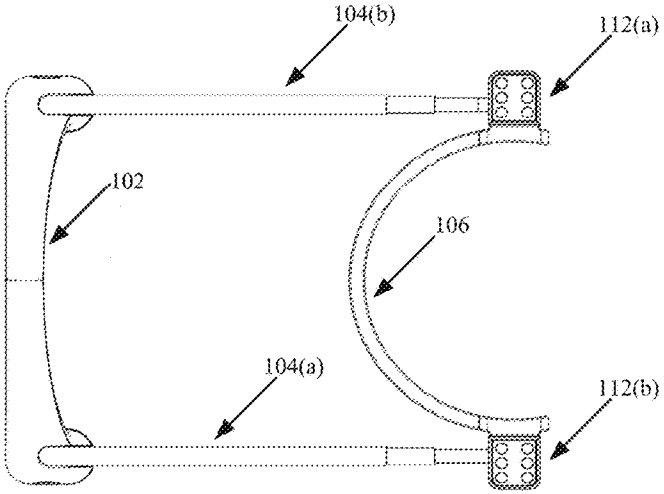

It is noted that in this disclosure, terms such as "comprises," "comprised," "comprising," and the like can have the meaning attributed to it in U.S. patent law; that is, they can mean "includes," "included," "including," "including, but not limited to" and the like, and allow for elements not explicitly recited. Terms such as "consisting essentially of" and "consists essentially of" have the meaning ascribed to them in U.S. patent law; that is, they allow for elements not explicitly recited, but exclude elements that are found in the prior art or that affect a basic or novel characteristic of the invention. Embodiments of the present invention are disclosed or are apparent from and encompassed by, the following description.

FIG. 1(*a*) shows a perspective view of a putting aid device 100 according to an embodiment of the present application. The putting aid device 100 includes an arch member 102, two arm members 104(*a*) and 104(*b*), which will be collectively referred to as 104, two base members 112(*a*) and 112(*b*), which will be collectively referred to as 112, and a cup member 106. The arch member 102 and the arm members 104 are attached with each other by an attachment mechanism 110. The arm members 104 are attached with the base members 112, which are attached with the cup member 106.

The putting aid device 100 uses the two arm members 104 to form a putting alley 114 that provides a visible path originating and extending from a golf hole (not shown) to a player (not shown). It is also conceivable that the alley 114 is formed by only one or more arm members. An arch member 102 is attached to one end of the alley to provide an additional marking of the location of the alley 114. The arch member 102 is attached to the arm members 104 in such a way so be removed from the arm members 104 or alternatively can slide along the arm members 104 transversely. According to an embodiment, the arch member 102 is attached to the arm members 104 by a snap-on mechanism, which allows the arch member to be readily removed from and reattached to the arm member 104. The snap-on mechanism also allows the arch member 102 to slide along the arm member 104. Such function allows, for example, the player to use the arch member (102) as a visual aid along the path of the putt (i.e., the alley 114) and also reduces the risk of the putter hitting the arch member (102) during the stroke. The arm members 104 are also made in such a way that allow the player to adjust the alley (114) width (either wider or narrower) depending on the drills being undertaken. The arch member 102 is also made in such a way as to accommodate the wider or narrower arm members (104). The arch member 102 may also be used as a handle of the putting aid device 100. The arch member 102 is preferably to have a profile that is substantially about 1 to 8 inches or 2 to 6 inches or 3 to 4 inches. Both the arm members 104 and the arch member 102 are preferably to have a color or a color pattern that forms a contrast with the grass, such as orange, yellow, red, black, grey, blue, or green.

When a player uses the golf putting aid device 100 on a golf course, which is further referred to as an outdoor mode, the cup member 106 is placed inside a golf cup while the arm members 104 and the arch member 102 are laid on the practice surface (typically a green). As a result, the alley 114 originates and extends from the golf hole to the direction to the player. The length of the alley 114 may be adjusted according to a user's preference. The alley 114 may cover the entire distance between the golf ball and the hole. Alternatively, the alley may cover only a partial distance thereof. Such a configuration provides flexibility to a player to practice putting at different distances.

FIGS. 1(*b*), 1(*c*), and 1(*d*) show a side view, a front view, and a top view, respectively, of the golf putting aid device 100 according to an embodiment of the present application. As shown in FIGS. 1(*b*) and 1(*c*), the arm members 104 are placed at the surface of the green with the arch member 102 standing up and the cup member 106 placed inside a golf cup. As shown in FIG. 1(*d*), the two arm members 114 are parallel with each other, forming an alley 114 in a generally rectangular shape, which has a constant width along the longitudinal direction of the alley 114. According to some embodiments of the present invention, the width of the arm members 114 can be adjusted to make the alley (114) either wider or narrower depending on the drills being undertaken. According to some embodiments of the present application, the alley 114 formed by the two arm members 104 may be in a plurality of shapes. For example, the two arm members 104 may form a "V" shaped alley whose width is gradually reduced in a direction from the arch member 102 to the cup member 106. Such a "V" shaped alley further eases the challenge of successfully holing a golf ball. According to an embodiment, the alley 114 may be formed by a single arm member 104, while the other arm member may be detached from the device 100 or may be moved into a vertical direction.

Figure 6:
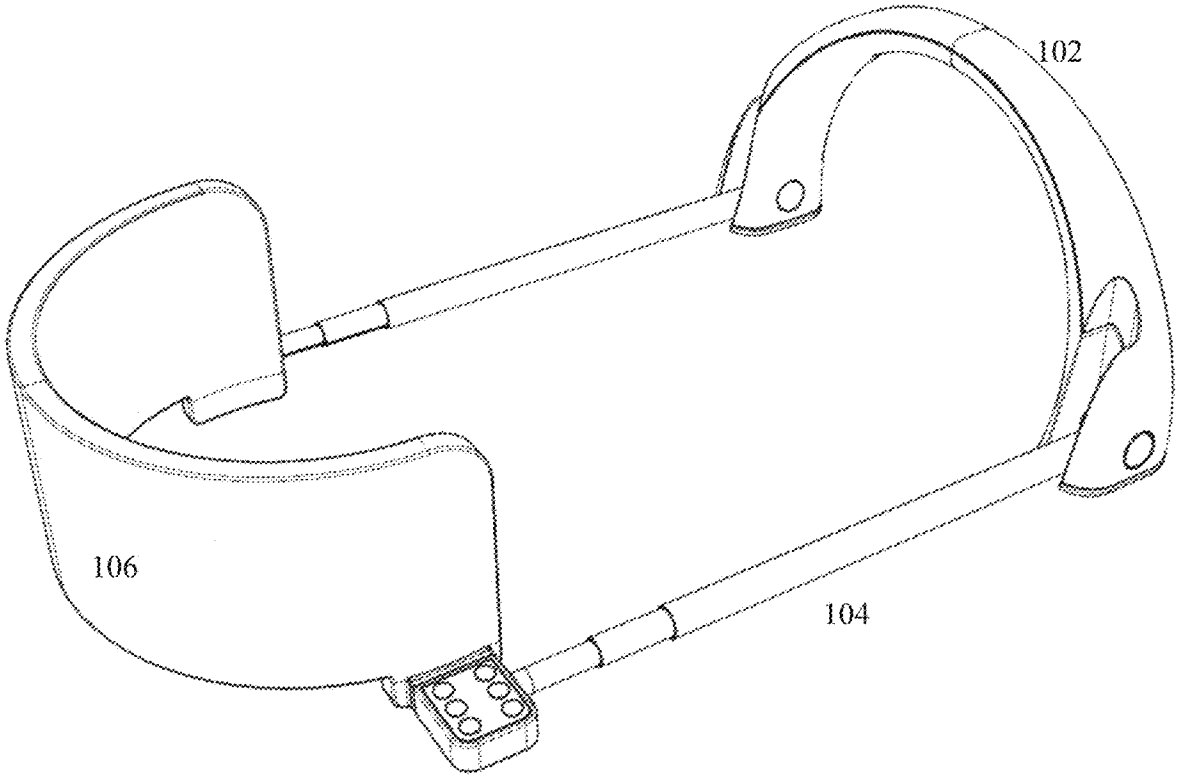
FIG. 6 shows a perspective view of a putting aid device in an outdoor mode according to an embodiment of the present application.

FIGS. 1(*a*), 1(*b*), 1(*c*), and 1(*d*) show the golf putting aid device 100 in an outdoor mode, in which the cup member 106 is placed inside a golf hole, while the arch member 102 and the arm members 104 stand on top of the green. In the outdoor mode, the arch member 102 and the cup member 106 are placed at opposite sides of the alley 114 formed by the two arm members 104. According to an embodiment, the golf putting aid device 100 also has an indoor mode, as shown in FIG. 6, in which the cup member 106 and the arch member 102 are placed at the same side of the alley 114 formed by the two arm members 104. A player uses the indoor mode to practice putting on surfaces where golf holes are not practicable. For example, a player may use the indoor mode to practice putting in a house, an office, a shopping mall, or a parking lot. To switch the putting aid device 100 from an outdoor mode to an indoor mode, the cup member 106 is moved from the position that is underneath the arm member 104 to the position that is above the arm member 104. The change of positions of the cup member 106 can be achieved by a plurality of types of mechanisms, including the use of hinges. According to an embodiment, the cup member 106 is capable of being detached from the base member 112 from an outdoor position and then reattached to the base member 112 at an indoor position. A snap on/off mechanism may be used as such a detachable mechanism. According to an embodiment, the cup member 106 may be swiveled or rotated around an axis to a predetermined indoor or outdoor position, forming the indoor mode or the outdoor mode.

Figure 7A:
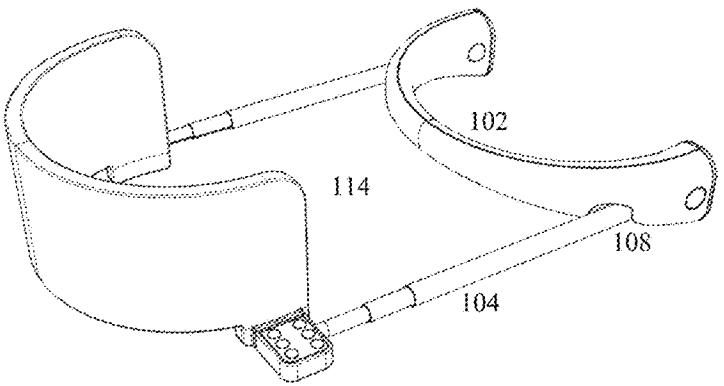
FIG. 7(*a*) shows a perspective view of a putting aid device according to an embodiment of the present application.
Figure 7B:
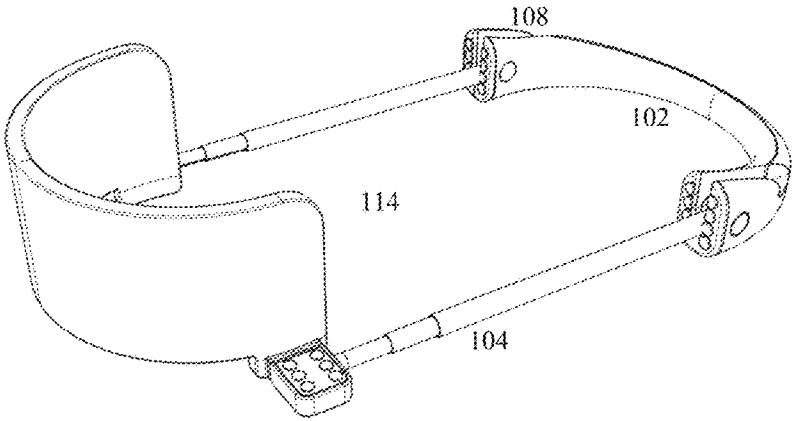

The putting aid device 100 is configured to have a plurality of mechanisms that reduce the overall configuration of the device when the device is in transportation or storage. According to an embodiment, the arm members 104 are extendable and retractable, thus being capable of reducing the overall length of the device. According to an embodiment, the arch member 102 includes grooves 108 whose size and shape conform to the arm members 104. As shown in FIGS. 7(*a*) and 7(*b*), the arch member 102 is capable of being rotated around the attachment mechanism 110 and may be folded into the alley 114 or outside of the alley 114, thus reducing the overall height of the device. When the arch member 102 is folded in to the alley 114, the grooves 108 accommodate the arm members 104, thus forming a compact storage configuration.

Figure 2:
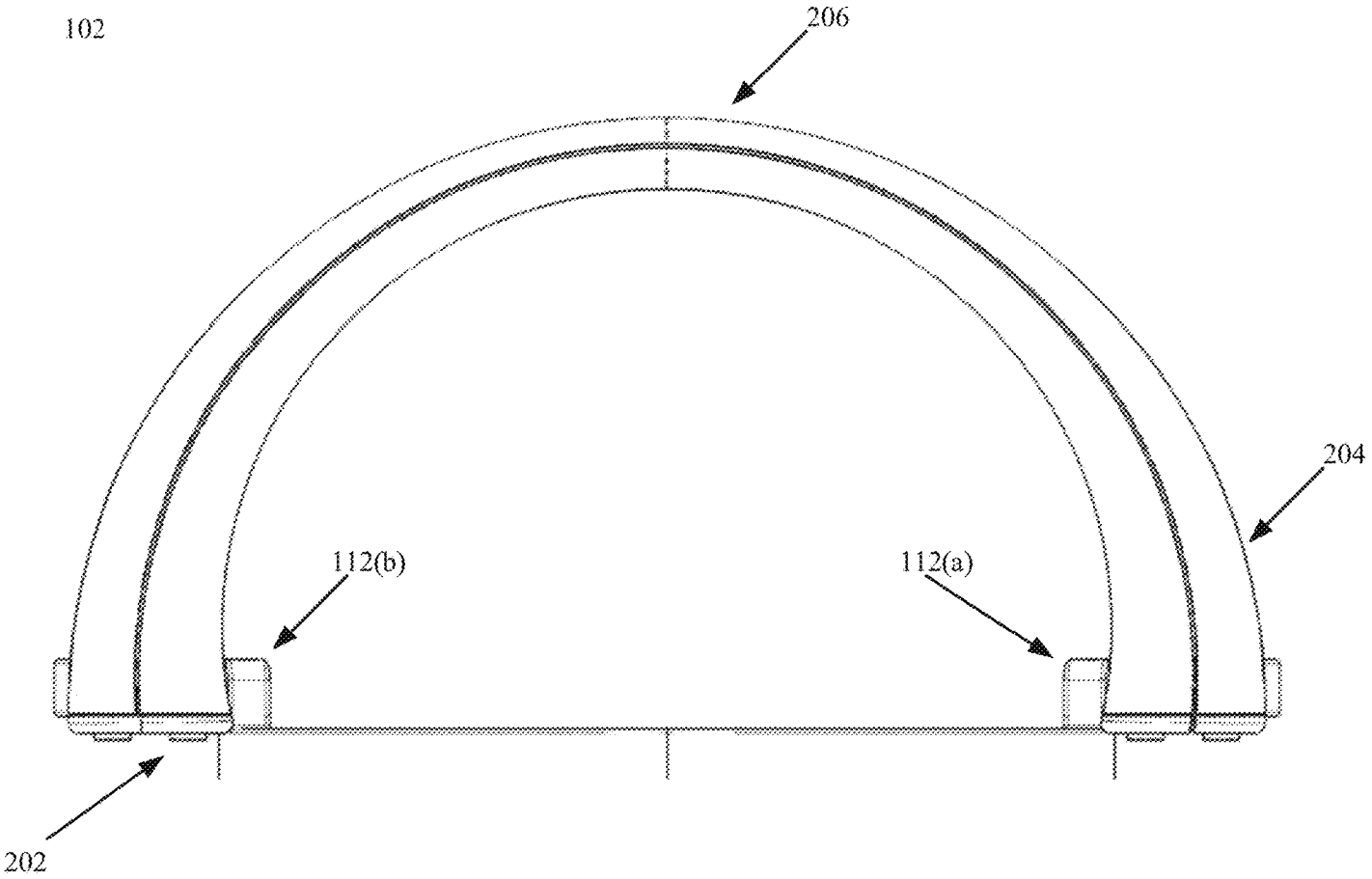
FIG. 2 shows a front view of an arch member 102 according to an embodiment of the present application.

FIG. 2 shows a front view of an arch member 102 according to an embodiment of the present application. It is noted that the grooves 108 are not seen in FIG. 2 because they are at the opposite side of the arch member 102. The arch member 102 shown in FIG. 2 has a semi-circular shape with its profiles gradually reduced from the bottom part 204 to the top 206. At the bottom part 204, a plurality of anti-slippery mechanisms 204 are used to help the putting aid device 100 to be stabilized at a preferred location. The anti-slippery mechanisms 204 may be anti-slipper pads, tees, or spikes that can be pushed into the green. According to an embodiment, the arch member 102 is not limited to a semi-circular shape. The arch member 102 may be in any shape, such as triangular, rectangular, circular, or elliptical shapes, as long as it provides adequate visibility to a player. According to an embodiment, the arch member 102 may even be formed by two upstanding poles or spikes that are attached to the arm member 104. The two upstanding poles or spikes are not needed to be connected with each other. The arch member 102 preferably has a relative high profile compared to the green so that the arch member 102 stands sufficiently above the green when used in the outdoor mode. According to an embodiment, the arch member 102 is about 4 inches tall. The arch member 102 may be made of any flexible or rigid materials as long as the strength of the material is capable of maintaining the shape of the arch member 102. According to an embodiment, the arch member 102 is preferably made of light weight materials such as plastics or wood.

Figure 3:
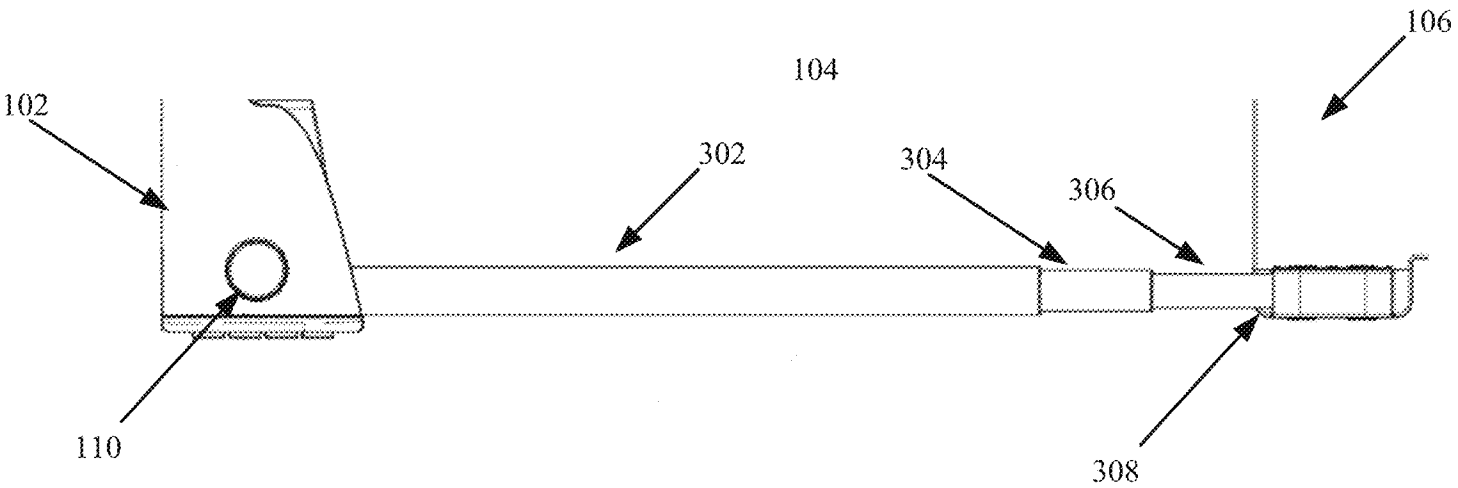
FIG. 3 shows an arm member 104 according to an embodiment of the present application.

FIG. 3 shows a side view of the arm members 104 according to an embodiment of the present application. The arm members 104 are designed to provide a visible alley 114 with variable length and/or width to a player. According to an embodiment, the arm members 104 are made of a flexible structure such as plastics, rubbers, woods, metals, strings, and ropes. Using arm members that are more flexible allows a player to use the device on a contoured surface (e.g., on an outdoor putting green that has one or more breaks). According to an embodiment, the arm members 104 include an extendable or retractable mechanism. As shown in FIG. 3, the arm members 104 include a plurality of sections 302, 304, and 306 that are coaxially attached with each other and are slidable within each other, forming an extendable and retractable mechanism. According to an embodiment, the arm members 104 are implemented as an antenna-like structure. At one end, the arm members 104 are attached to the arch member 102 by a rotatable mechanism 110. At the other end, the arm members 104 are attached to the base member 112 or the cup member 106 via an attachment mechanism 308. The arm members 104 preferably have a height that is tall enough to prevent the golf ball from rolling over the arm members 104. According to an embodiment, the height of the arm members 104 may be between 5% and 100% of the diameter of a golf ball or between 20% and 80% of the diameter of a golf ball. According to another embodiment, the arch member 102 is attached to the arm members 104 in such a way so it can be easily removed from the arm members 104 or alternatively can slide along the arm members 104 transversely (e.g., closer or farther away from the hole).

Figure 4:
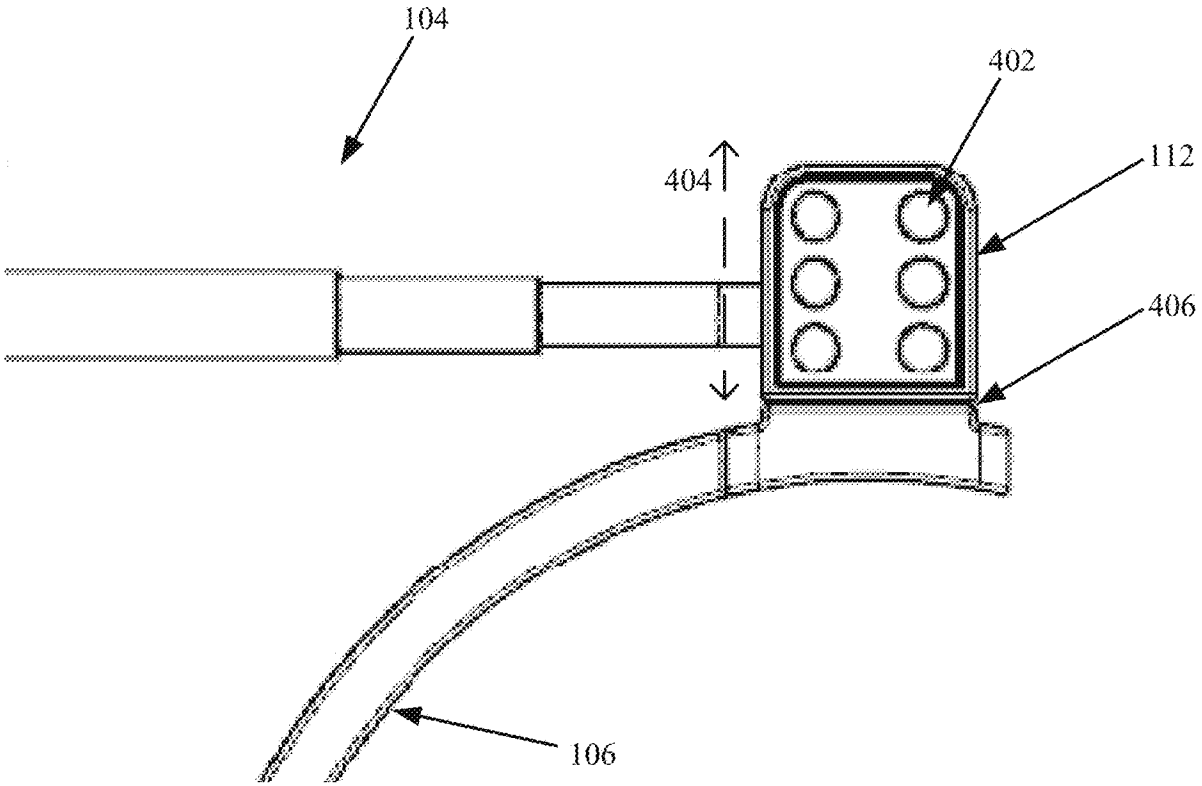
FIG. 4 shows a base member 112 according to an embodiment of the present application.

FIG. 4 shows a top view of a base member 112 according to an embodiment of the present application. The base member 112 is connected with both the arm member 104 and the cup member 106. It is noted that the base member 112, the arm members 104, and the cup member 106 may be formed by separate and independent parts or may represent different functional portions of a single part. For example, the base member 112 and the cup member 106 may be made from a single part made of polymeric materials and formed by a molding or extruding process.

According to an embodiment, the attachment mechanism 404 between the arm member 104 and the base member 112 is configured to allow the arm member 104 to move along a lateral direction of the golf alley 114, thus providing an alley with variable width. The attachment mechanism 404 is also configured to allow the arm member 104 to rotate about the base member 112 along a vertical axis, thus forming a wide range of angles between the arm member 104 and the base member 112. It is noted that the arm member 104 is not limited to be attached inside the base member 112 as shown in FIG. 4. The arm members 104 may be attached to the sides and surfaces of the base member 112.

According to an embodiment, the attachment mechanism 406 between the base member 112 and the cup member 106 may be a permanent attachment mechanism according to an embodiment of the present application. A permanent attachment mechanism includes glue, screws, and fusion. According to an embodiment, the cup member 106 and the base member 112 represent integral parts of a signal piece of material. For example, the cup member 106 and the base member 112 may be formed by polymeric materials through a molding or extruding process. When a permanent attachment mechanism is used between the base member 112 and the cup member 106, the attachment mechanism 404 between the base member 112 and the arm member 104 is preferably to be rotational that allows both the base member 112 and the cup member 106 to rotate along an axis that is substantially perpendicular to the arm member 104.

The attachment mechanism 406 between the base member 112 and the cup member 106 may also be non-permanent. According to an embodiment, the cup member 106 and the base member 112 may be magnetically attached with each other, which allows a manual detachment by forcing the base member 112 and the cup member 106 away from each other. According to an embodiment, the attachment between the cup member 106 and the base member 116 may be a snap on/off mechanism. The attachment mechanism 406 may also be a rotational mechanism according to an embodiment of the present application. A rotational mechanism allows the cup member 106 to rotate around the base member 112. The rotational mechanism includes hinges and ball bearings.

The base member 112 also includes a plurality of anti-slippery pads 402. The anti-slippery pads 402 may be placed on the top surface, the bottom surface, or on both surfaces of the base member 112. The base member 112 is not limited to a particular shape or size. According to an embodiment, the size of the base member 112 is configured to avoid adding unnecessary lateral dimensions to the putting aid device 100. For example, the lateral dimension of the putting aid device 100 as marked by the base member 112 is substantially the same as that as marked by the arch member 102 as shown in FIGS. 1(*c*) and 1(*d*).

Figure 5:
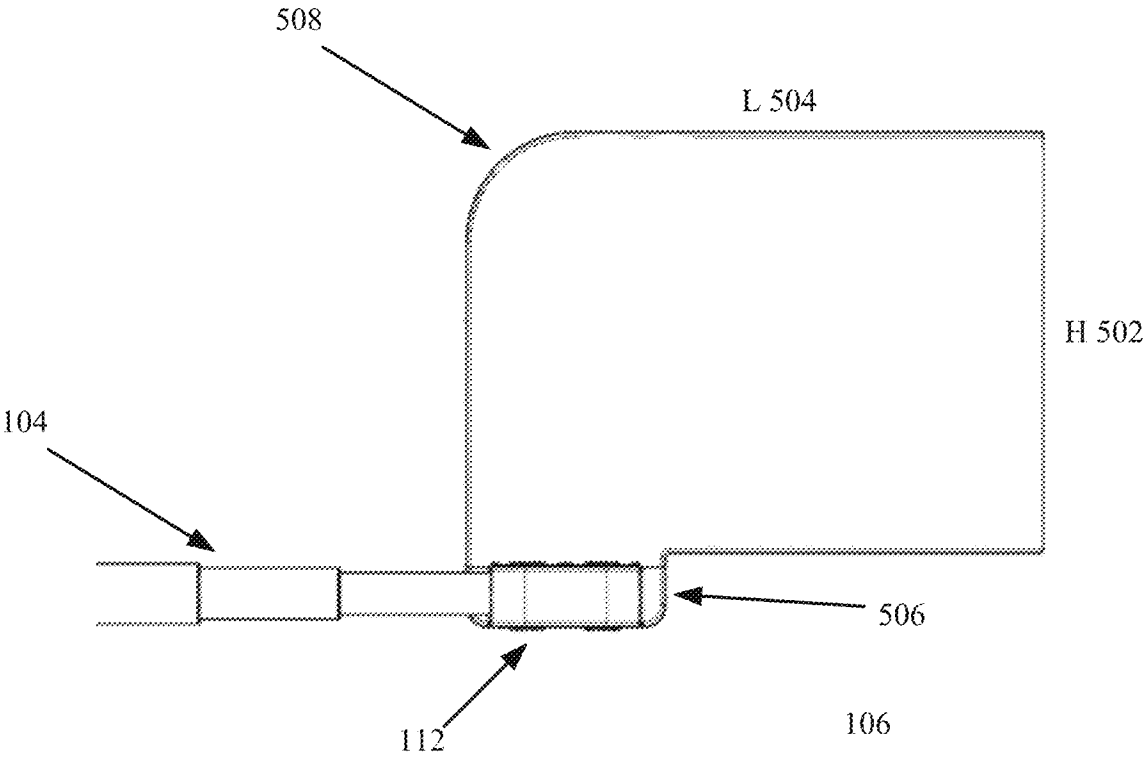
FIG. 5 shows a cup member 106 according to an embodiment of the present application.

FIG. 5 shows a cup member 106 according to an embodiment of the present application. The cup member 106 is configured to have a shape and size that is capable of being fit into a golf hole. For example, the cup member 106 may represents a substantial semi-cylinder as shown in FIG. 1(*d*). The length L 504, which corresponds approximately to the radius of the cup member 106, is slightly smaller than that of a standard golf hole. For example, the length L 504 may be 2.12 inches, 2 inches, 1.9 inches, or even smaller. The height H 502 of the cup member 106 may not exceed the depth of a golf hole, such as 4 inches. According to an embodiment, the height H is configured to be substantially the same as the diameter of a golf ball. According to an embodiment, the height H is configured to be substantially the same as the arch member 102. The cup member 106 may also include an attachment portion 506 that represents an extension that protrudes from the body of the cup member 106. The attachment portion 506 is used as the attachment area with the base member 112. The corner 508 of the cup member 106 is preferably to have a smooth configuration such as a curve to remove sharp edges and tips. The cup member 106 may be made of any material that has the mechanical strength to maintain its shape, such as plastics, rubber, wood, and metal.

FIG. 6 shows a perspective view of a putting aid device 100 in an indoor mode according to an embodiment of the present application. The indoor mode is used when the putting aid device is not used on a golf course where golf cups are available. A golf player uses the indoor mode to practice putting in houses, backyards, offices, or on any locations or surfaces that a golf cup is not readily available. The cup member 106 simulates the function of a golf hole and provides the player a sense of completion when a golf ball is put into the cup member 106.

FIG. 7(*a*) shows a storage configuration of a golf putting aid device according to an embodiment of the present application. The arch member 102 is folded into the alley 114. It is noted that the arm members 104 fit into the grooves 108.

FIG. 7(*b*) shows another storage configuration of a golf putting aid device according to an embodiment of the present application. The arch member 102 is folded to an area that is outside of the alley 114 and is substantially in the same plane as that of the alley 114.

Figure 8B:
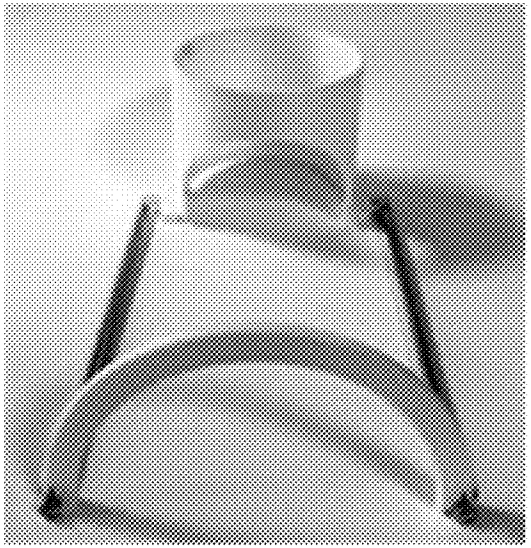
FIG. 8(*a*) shows a perspective view of a putting aid device 800 according to an embodiment of the present application.
Figure 8A:
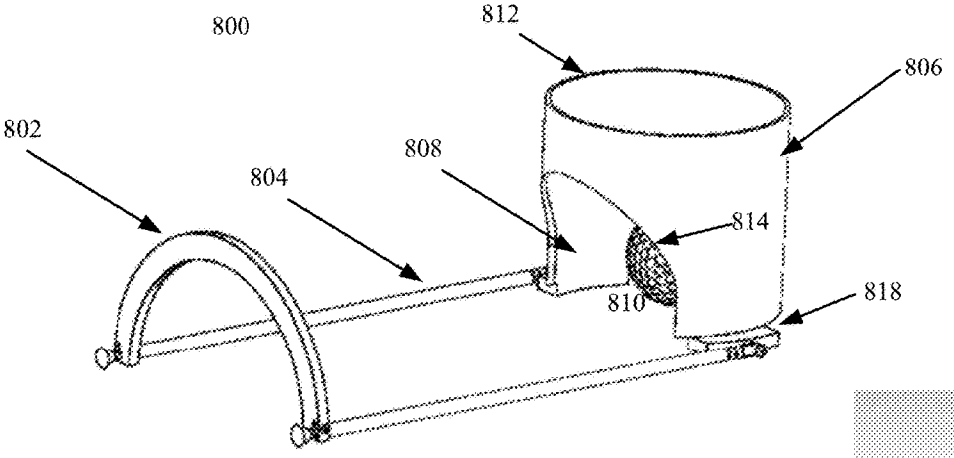

FIG. 8(*a*) shows a perspective view of a putting aid device 800 according to an embodiment of the present application. The putting aid device 800 includes an arch member 802, arm members 804, and a cup member 806. The arch member 802 has a semi-circular shape formed by a band-like plastics with a constant width. The arm members 104 are attached to the sides of the base member 818 and are rotatable around the base member 818. The cup member 806 includes an upper part 812 that represents a full cylinder and a lower part 810 that represents a semi-cylinder and is formed by cutting off a predetermined portion 808 from a full cylinder. The predetermined portion 808 preferably has a dimension greater than a golf ball 814. By having a full cylinder portion, the stabilization of the cup member 806 inside the golf hole is improved. The full cylinder portion also provides a player the real feel of taking a golf ball from the hole while the putting aid device 800 is used in the indoor mode. FIG. 8(*b*) shows an example of a reduction to practice of the putting aid device 800 of FIG. 8(*a*).

Figure 9A:
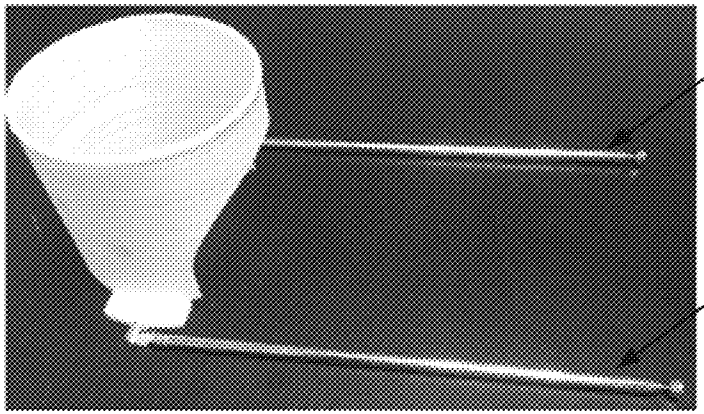
FIG. 9(*a*) shows a perspective view of a putting aid device 900 according to an embodiment of the present application.
Figure 9B:
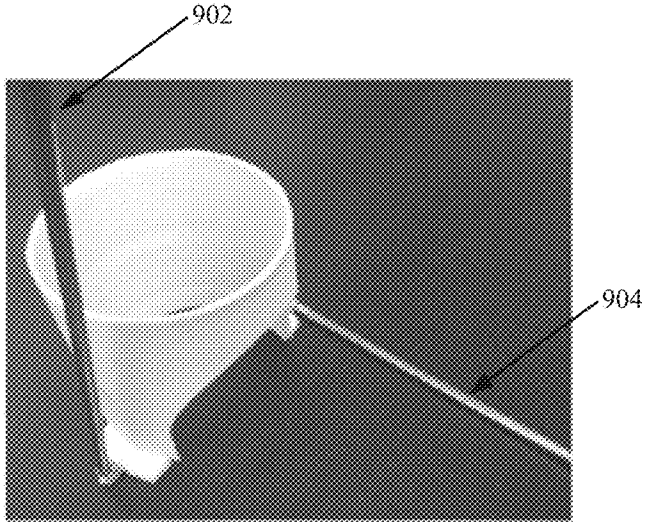

FIG. 9(*a*) shows a perspective view of a golf putting aid device 900 according to an embodiment of the present application. The golf putting aid device 900 uses two arm members 902 and 904 to form a golf alley and does not use an arch member. The length of the two arm members 904 and 902 is independently adjustable. The two arm members 902 and 904 may also be independently rotated around the base member. For example, as shown in FIG. 9(*b*), one arm member 902 is rotated to a direction that is perpendicular to the other arm member 904.

Figure 10:
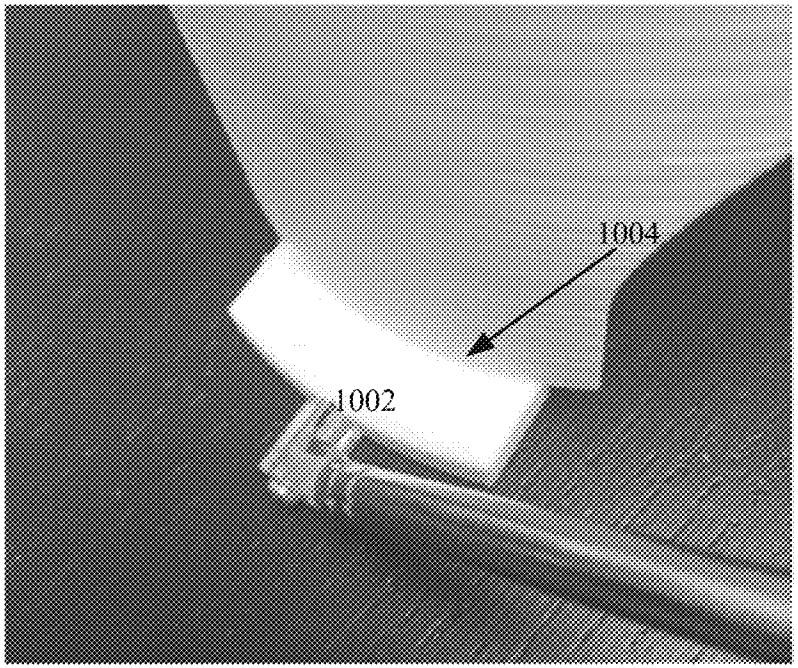
FIG. 10 shows attachment mechanisms between an arm member and a base member and between the base member and a cup member according to an embodiment of the present application.

FIG. 10 shows attachment mechanisms among the arm members, the base members, and the cup member according to an embodiment of the present application. The base member and the cup member are formed by an integral part of a single piece of material. The attachment mechanism 1004 between the base member and the cup member represents the material that forms the base member and the cup member themselves. The attachment mechanism 1002 between the arm members and the base member is implemented as a hinge attached to a side of the base member.

According to some embodiments, the putting aid device may include electronic components inside the arch member that provides visual or acoustic responses when a golf ball moves through the arch member. The putting aid device may also include a ball redirecting mechanism that directs the golf ball to the outside of the cup member or even directs the golf ball from the cup member to a player.

The particular embodiments disclosed above are illustrative only, as the invention may be modified and practiced in different but equivalent manners apparent to those skilled in the art having the benefit of the teachings herein. Further-more, no limitations are intended to the details of construction or design herein shown, other than as described in the paragraphs below. It is therefore evident that the particular embodiments disclosed above may be altered or modified and all such variations are considered within the scope and spirit of the invention. Although illustrative embodiments of the invention have been described in detail herein with reference to the accompanying drawings, it is to be understood that the invention is not limited to those precise embodiments, and that various changes and modifications can be effected therein by one skilled in the art without departing from the scope and spirit of the invention.

What is claimed is:

1. A golf putting aid device comprising: an alley indicating a path of a golf putt and being formed by two parallel arm members with an adjustable length, one end of the alley being rotatably attached to a cup member that has a cylindrical shape configured to receive a golf ball, and another end of the alley being attached to an arch member that is configured to mark a location of the alley, wherein the cup member and the arch member are configured to be disposed at opposite sides of the alley in an outdoor mode, and the cup member and the arch member are configured to be disposed at the same side of the alley in an indoor mode; wherein in said outdoor mode the cup is configured to be pivoted and placed in a golf hole; wherein, in both the outdoor mode and the indoor mode, the alley is configured to extend from the cup member and allow a golf ball to be received by the cup member, and wherein the alley is formed only by the parallel arm members such that a user is allowed to practice golf putting on an outdoor surface or an indoor surface, and wherein each parallel arm member is independently rotatable around the cup member; and wherein the arch member is capable of being folded to a same plane of the alley in a storage position and is capable of forming a 90 degree angle with the alley when the golf putting aid device is used to aid golf putting.

2. The golf putting aid device of claim 1, wherein the alley is configured to have adjustable width.

3. The golf putting aid device of claim 1, wherein the cylindrical cup member is rotatable around the arm members.

4. The golf putting aid device of claim 1, wherein the cup member includes a semi-cylinder portion.

5. The golf putting aid device of claim 4, wherein the cup member includes a full cylinder portion.

6. The golf putting aid device of claim 1, further comprising a base member that attaches to both the arm member and the cup member.

7. The golf putting aid device of claim 6, wherein the base member and the cup member are portions of a single part.

8. The golf putting aid device of claim 6, wherein the cup member is attached to the base member by a snap on/off mechanism.

9. The golf putting aid device of claim 8, wherein the base member has a plurality of anti-slippery pads.

10. The golf putting aid device of claim 1, wherein the arch member includes at least one groove configured to accommodate a predetermined portion of the arm member when the arch member is in the storage position.

11. The golf putting aid device of claim 1, wherein the arch member has a generally semi-circle configuration.

12. The golf putting aid device of claim 11, wherein the arch member gradually reduces its profile from a bottom part to a top part.

13. The golf putting aid device of claim 1, wherein the arch member is configured to slide along the parallel arm members.

14. The golf putting aid device of claim 1, wherein the arch member is removable from the parallel arm members.

15. The golf putting aid device of claim 1, wherein the arm member includes a plurality of sections that are coaxially attached with each other.

* * * * *